United States Patent [19]

Shimomura et al.

[11] Patent Number: 5,028,580

[45] Date of Patent: Jul. 2, 1991

[54] HEAT SENSITIVE RECORDING MATERIAL

[75] Inventors: Akihiro Shimomura; Toshimasa Usami, both of Shizuoka, Japan

[73] Assignee: Fuji Photo Film Co., Ltd., Kanagawa, Japan

[21] Appl. No.: 252,412

[22] Filed: Oct. 3, 1988

[30] Foreign Application Priority Data

Oct. 2, 1987 [JP] Japan ..... 62-250456

[51] Int. Cl.[5] ..... B41M 5/18

[52] U.S. Cl. ..... 503/207; 427/152; 503/200; 503/226

[58] Field of Search ..... 427/150–152; 428/913, 914, 323; 503/207, 200, 226

[56] References Cited

U.S. PATENT DOCUMENTS 4,820,682 4/1989 Shimomura et al. ..... 503/207

4,840,933 6/1989 Usami et al. ..... 503/213

FOREIGN PATENT DOCUMENTS 138483 4/1985 European Pat. Off. ..... 428/913

194106 9/1986 European Pat. Off. ..... 503/227

*Primary Examiner*—Pamela R. Schwartz

*Attorney, Agent, or Firm*—Sughrue, Mion, Zinn, Macpeak & Seas

[57] ABSTRACT

A heat sensitive material which is comprised of a support having thereon a transparent heat sensitive layer and at least one layer selected from among a protective layer, a subbing layer and backing layer, wherein at least one of constituent layer contains fine grains of at least one crystalline metal oxide which has a volume resistivity ranging from $10^{\circ}$ to $10^{5}$ ohm·cm. An amount of said crystalline metal oxide is 0.0001 g–1 g per $m^2$ and the best metal oxide is $SnO_2$.

4 Claims, No Drawings

HEAT SENSITIVE RECORDING MATERIAL

FIELD OF THE INVENTION

The present invention relates to a heat sensitive recording material and, more particularly, to a heat sensitive recording material having a heat sensitive layer excellent in transparency.

BACKGROUND OF THE INVENTION

A heat sensitive recording method has many advantages, such as (1) no need of development, (2) embodying a quality akin to that of plain paper when a paper support is used, (3) easiness in handling, (4) high density of the developed color images, (5) simplicity and cheapness of a recording apparatus to be used thereof, (6) noiseless in the recording operation, and so on. Such being the case, this method has recently come into a rapid prevalence in the field of facsimile and printer, and further new uses of heat sensitive recording, e.g., the field of making labels to be used in POS, etc., are being enlarged.

Under these circumstance, it has recently been desired to develop a transparent heat sensitive recording material on which images can be directly recorded with a thermal head for the purposes of adaptation to multicoloring, or application to an overhead projector (which is abbreviated as OHP, hereinafter). Therefore, we have previously proposed (in Japanese Patent Application No. 88197/87) a heat sensitive recording material having a substantially transparent heat sensitive layer formed by coating and then drying a composition comprising microcapsules containing a colorless or light colored electron donating dye precursor and an emulsified dispersion prepared by dispersing of emulsified dispersion, a color developer dissolved in an organic solvent slightly soluble or insoluble in water.

On the other hand, as the conversion of materials constructing a heat sensitive paper carrying system from metallic materials to plastic ones has been driven with the advance of reduction in size and weight of apparatuses used for heat sensitive recording materials, e.g., facsimile and like, troubles due to electrification of heat sensitive paper through contact with a stock case, a tray, rollers for carrying and so on tend to frequently occur. Namely, the recording apparatuses of this type have defects, for instance, such that the electrified heat sensitive paper sheets cause electrostatic adhesion to one another or to the sheet carrying system to suffer from a so-called "Jamming" phenomenon, and it happens that thermal recording fails to be made on electrified heat sensitive paper sheets owing to interference from dust, such as paper powder, etc., sticked to the surfaces thereof.

SUMMARY OF THE INVENTION

Therefore, a first object of the present invention is to provide a heat sensitive recording material which ensures the smooth carrying inside a recording apparatus.

A second object of the present invention is to provide a heat sensitive recording material which is hard to cause static electrification due to rubbing, or free from adhesion of dust thereto and so on, and thereby enable reliable recording.

A third object of the present invention is to provide a highly transparent heat sensitive recording material which hardly causes static electrification due to rubbing to ensure the smooth carrying inside a recording apparatus, and has aptitudes for multicolor recording and OHP use.

Above objects of the present invention were attained by a heat sensitive recording material which is comprised of a support having thereon constituent layers including a heat sensitive layer formed by coating a composition containing both microcapsules containing a colorless or light colored elecron donating dye precursor and an emulsified dispersion prepared by dispersing a color developer dissolved in an organic solvent slightly soluble or insoluble in water, and then drying the coated composition, and at least one layer selected from among a protective layer provided on the heat sensitive layer, a subbing layer provided beneath the heat sensitive layer and a backing layer provided on the back side of the support; wherein at least one of said constituent layers contains fine grains of at least one crystalline metal oxide selected from a group consisting of ZnO, $TiO_2$, $SnO_2$, $Al_2O_3$, $In_2O_3$, $SiO_2$, MgO, BaO, $MoO_3$ and compound oxide constituted with two or more of said metal oxides, each of which has a volume resistivity ranging from $10^0$ to $10^5$ ohm·cm.

The heat sensitive recording material of the present invention has an excellent antistatic property. Consequently, adhesion of dust like paper powder is hardly caused therein, and it dose not occur that there are some spots on which thermal printing failed due to dust sticked thereto.

In addition, even when the heat sensitive recording material is rubbed with the parts of a recording apparatus in carrying it through the apparatus, static electrification is not caused therein, so paper stopping such as a jamming phenomenon dose not occur, that is to say, smooth travelling of the recording material through the recording apparatus becomes feasible, and omission of records and troubles in the apparatus can be prevented.

DETAILED DESCRIPTION OF THE INVENTION

Electron donating dye precursors to be employed in the present invention are selected properly from known colorless or light colored compounds of the kind which can develop their colors by donating an electron or accepting a proton of an acid or the like. These compounds have such a skeleton as that of lactone, lactam, sultone, spiropyran, ester, amide, etc., as a part of their structures, and these skeletons undergo ring-opening or bond cleavage upon contact with a color developer. Preferred examples of such compounds include triarylmethane compounds, diphenylmethane compounds, xanthene compounds, thiazine compounds, spiropyran compounds and so on.

Particularly preferred compounds are those represented by the following general formula:

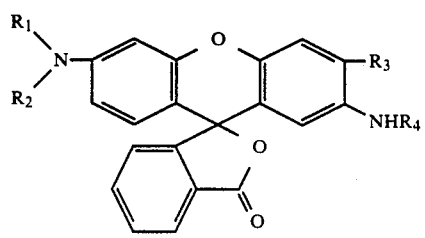

In the foregoing formula, $R_1$ represents an alkyl group containing 1 to 8 carbon atoms; $R_2$ represents an alkyl or alkoxyalkyl group containing 4 to 18 carbon atoms, or a tetrahydrofuryl group; $R_3$ represents a hydrogen atom, an alkyl group containing 1 to 15 carbon atoms, or a halogen atom; and $R_4$ represents a substituted or unsubstituted aryl group containing 6 to 20 carbon atoms. As substituent group for $R_4$, alkyl, alkoxy and halogenated alkyl groups containing 1 to 5 carbon atoms, and halogen atoms are preferred.

Microencapsulation of the above-described color former in the present invention can prevent generation of fog during production of a heat sensitive material and, at the same time, can improve a freshness keeping quality of a heat sensitive material and a keeping quality of the record formed. Therein, the image density at the time of recording can be heightened by properly selecting a material and a method for forming a microcapsule wall. A preferred amount of the color former used is 0.05 to 5.0 g per square meter.

Suitable examples of wall materials for microcapsules include polyurethane, polyurea, polyester, polycarbonate, urea/formaldehyde resin, melamine resin, polystyrene, styrene/methacrylate copolymer, styrene/acrylate copolymer, gelatin, polyvinyl pyrrolidone, polyvinyl alcohol, and so on. These macromolecular substances can be used in combination of two or more thereof in the present invention.

Of the above-cited macromolecular substances, polyurethane, polyurea, polyamide, polyester, and polycarbonate are preferred in the present invention. In particular, polyurethane and polyurea can bring about good results.

Microcapsules to be employed in the present invention are preferably prepared by emulsifying a core material containing a reactive substance like a color former, and then forming a wall of a macromolecular substance around the droplets of the core material to microencapsulate the core material. Therein, reactants to produce a macromolecular substance are added to the inside and/or the outside of the oily droplets. For details of microcapsules which can be preferably employed in the present invention, e.g., for production methods of microcapsules which can be preferably used, descriptions in Japanese Patent Application (OPI) No. 222716/84 (the term "OPI" as used herein means an "unexamined published application"), and so on can be referred to.

An organic solvent to constitute the oily droplets can be arbitralily selected from known organic solvents, however, it is desired to use the aftermentioned organic solvents which are suitable to dissolve color developers are used, since these solvents are excellent as a solvent to dissolve the before mentioned electron donating dye precursor and can increase coloring density at heat recording, moreover, can decrease fog.

Desirable microcapsules which are produced in the above-described manner are not those of the kind which are disrupted by heat or pressure, but those of the kind which have a microcapsule wall through which reactive substances present inside and outside the individual microcapsules respectively can permeate at high temperature to react with each other.

Multicolored neutral tints can be effected by preparing some kinds of microcapsules having walls differing in glass transition point through proper selection of wall materials, and optional addition of glass transition point controlling agents (e.g., plasticizers described in Japanese Patent Application (OPI) No. 119862/85) to the wall materials, respectively, and further by combining selectively colorless electron donating dye precursors differing in hue with their respective color developers. Therefore, the present invention is not limited to a monochromatic heat sensitive recording material but can be applied to a two-color or multicolor heat sensitive recording material and a heat sensitive recording material suitable for recording of graded image.

In addition, a photodiscoloration inhibitor as described, e.g., in Japanese Patent Application (OPI) Nos. 125470/85, 125471/85, and 125472/85 can be added, if desired.

Color developers to be employed in the present invention, which undergo the color development reaction with electron donating colorless precursors when heated, can be those selected properly from known color developers. For instance, suitable examples of color developers to be combined with leuco dyes include phenol compounds, sulfur-contained phenolic compounds, carboxylic acid compounds, sulfon compounds, urea or thiourea compounds, and so on. Details of the color developers are described, e.g., in "Kami Pulp Gijutsu Times," pp. 49–54, and pp. 65–70 (1985). Of such color developers, those having melting points of 50° to 250° C., particularly phenols and organic acids which have melting points of 60° to 200° C. and are hardly soluble in water are preferred over others. Combined use of two or more of color developers is desirable because of increase in solubility.

Color developers preferred particularly in the present invention are represented by the following general formulae (I) to (IV):

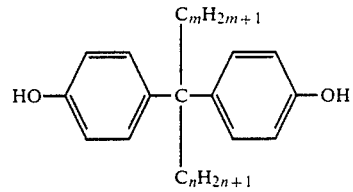

(I)

m=0–2, n=2–11

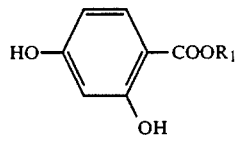

(II)

$R_1$ is an alkyl group, an aryl group, an aryloxy group, or an aralkyl group. In particular, methyl group, ethyl group and butyl group are preferred as $R_1$.

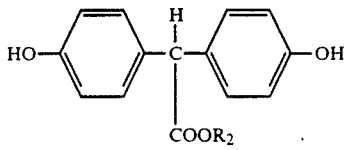

(III)

$R_2$ is an alkyl group. In particular, butyl group, pentyl group, heptyl group, and octyl group are preferred.

(VI)

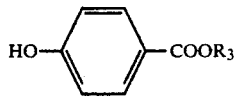

$R_3$ is an alkyl group, an aryloxy group, or an aralkyl group.

In the present invention, such a color developer is used in a form of emulsified dispersion. The dispersion can be prepared by dissolving color developers in an organic solvent slightly soluble or insoluble in water and mixing the resulting solution with an aqueous phase, which contains a surface active agent and a water-soluble high polymer as a protective colloid, to emulsify and to disperse the solution in the aqueous phase.

An organic solvent to be used for dissolving the color developers can be properly selected from known oils.

In the present invention, esters having high boiling point or before mentioned oils used for pressure sensitive materials are preferable. Some of desirable oils are compounds represented by the following general formulae (V) to (VII), triarylmethanes (such as tritoluylmethane, toluyldiphenyl-methane), terphenyl compounds (such as terphenyl), alkylated diphenyl ethers (such as propyldiphenyl ether), hydrogenated terphenyl compounds (such as hexahydroterphenyl), diphenyl ethers, chlorinated paraffins and so on. In particular, esters are more preferable from a view point of a stability of the color developer emulsion.

(V)

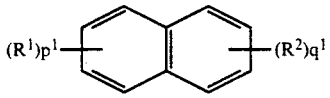

In the above formula, $R^1$ represents a hydrogen atom, or an alkyl group containing 1 to 18 carbon atoms; $R^2$ represents an alkyl group containing 1 to 18 carbon atoms; and $p^1$ and $q^1$ each represents an integer of 1 to 4, provided that the total number of alkyl groups therein is 4 or less. Preferred alkyl groups represented by $R^1$ and $R^2$ are those containing 1 to 8 carbon atoms.

(VI)

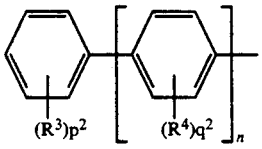

In the above formula, $R^3$ represents a hydrogen atom, or an alkyl group containing 1 to 12 carbon atoms; $R^4$ represents an alkyl group containing 1 to 12 carbon atoms; and n is 1 or 2. $p^2$ and $q^2$ each represents an integer of 1 to 4. The total number of alkyl groups is 4 or less in case of n=1, while it is 6 or less in case of n=2.

(VII)

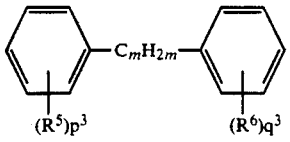

In the above formula, $R^5$ and $R^6$, which may be the same or different, each represents a hydrogen atom, or an alkyl group containing 1 to 18 carbon atoms. m represents an integer of 1 to 13. $p^3$ and $q^3$ each represents an integer of 1 to 3, provided that the total number of alkyl groups is 3 or less.

Of alkyl groups represented by $R^5$ and $R^6$, those containing 2 to 4 carbon atoms are particularly preferred.

Specific examples of the compounds represented by the formula (V) include dimethylnaphthalene, diethylnaphthalene, diisopropylnaphthalene, and the like.

Specific examples of the compounds represented by the formula (VI) include dimethylbiphenyl, diethylbiphenyl, diisopropylbiphenyl, diisobutylbiphenyl, and the like.

Specific examples of the compounds represented by the formula (VII) include 1-methyl-1-dimethylphenyl-1-phenylmethane, 1-ethyl-1-dimethylphenyl-1-phenylmethane, 1-propyl-1-dimethylphenyl-1-phenylmethane, and the like.

Specific examples of esters include phosphates (e.g., triphenyl phosphate, tricresyl phosphate, butyl phosphate, octyl phosphate, cresyl-bi-phenyl phosphate), phthalates (e.g., dibutyl phthalate, 2-ethylhexyl phthalate, ethyl phthalate, octyl phthalate, buthlbenzyl phthalate, tetrahydro dioctyl phthalate, benzoates (e.g., ethyl benzoate, propyl benzoate, butyl benzoate, isopentyl benzoate, benzyl benzoate), abietates (e.g., ethyl abietate, benzyl abietate), dioctyl adipate, diethyl succinate, isodecyl succinate, dioctyl azelate, oxalates (e.g., dibutyl oxalate, dipentyl oxalate), diethyl malonate, maleates (e.g., dimethyl maleate, diethyl maleate, dibutyl maleate), tributyl citrate, sorbic esters (methyl sorbate, ethyl sorbate, butyl sorbate), sebacic esters (dibutyl sebacate, dioctyl sebacate), ethyleneglycol esters (e.g., formic acid monoesters and diesters, butyric acid monoesters and diesters, lauric acid monoesters and diesters, palmitic acid monoesters and diesters, stearic acid monoesters and diesters, oleic acid monoesters and diesters), triacetin, diethylcarbonate, diphenylcarbonate, ethylenecarbonate, propylenecarbonate, boric acid esters (e.g., tributyl borate, tripentyl borate). Of these esters, it is particularly preferred to use tricresyl phosphate from the standpoint of stabilization of emulsified dispersion of the color developers.

Organic solvents having low boiling point can be added to the foregoing organic solvents. Some of these organic solvents are ethylacetate, isopropyl acetate, butyl acetate, methylene chloride, and the like.

Water soluble high polymers to be contained as a protective colloid in an aqueous phase, which is to be mixed with an oily phase wherein color developers are dissolved, can be selected properly from known anionic, nonionic or amphoteric high polymers. Of these high polymers, polyvinylalcohol, gelatin, cellulose derivatives and the like are preferred.

Surface active agents to be contained additionally in the aqueous phase can be selected properly from anionic or nonionic surface active agents of the kind which do not cause any precipitation or condensation by interaction with the above-described protective colloids. As examples of surface active agents which can be preferably used, mention may be made of sodium alkylbenzenesulfonates (such as sodium laurylbenzenesulfonate), sodium dioctylsulfosuccinates, polyalkylene glycols (such as polyoxyethylene nonylphenyl ether) and so on.

An emulsified dispersion of color developers to be used in the present invention can be prepared with ease by mixing an oil phase containing the color developers and an aqueous phase containing a protective colloid and a surface active agent with a general means for preparing a fine grain emulsion, such as a high-speed stirrer, an ultrasonic disperser or so on, to disperse the former phase into the latter phase.

To the emulsified dispersion thus obtained, melting point depressants for the color developers can be added, if desired. Some of these melting point depressants have such a function as to control glass transition points of the capsule walls described hereinbefore, too. Specific examples of such melting point depressants include hydroxy compounds, carbamate compounds, sulfonamide compounds, aromatic methoxy compounds and so on. Details of these compounds are described in Japanese Patent Application No. 244190/84.

These melting point depressants can be used in an amount of 0.1 to 2 parts by weight, preferably 0.5 to 1 part by weight, per 1 part by weight of color developer whose melting point is to be depressed. It is to be desired that the melting point depressant and the color developer, whose melting point can be depressed thereby, should be used in the same place. When they are added to separate places, a preferred addition amount of the melting point depressant is 1 to 3 times of that of the above-described one.

For the purpose of prevention of sticking to a thermal head, and improvement on writing quality, pigments such as silica, barium sulfate, titanium oxide, aluminium hydroxide, zinc oxide, calcium carbonate, etc., styrene beads, or fine particles of urea/melamine resin and so on can be added to the heat sensitive recording material of the present invention.

In order to keep the transparency of the heat sensitive layer, a protective layer may be provided on the heat sensitive layer in a conventional manner for the purpose of acquisition of keeping quality and stability.

Details of the protective layer are described, e.g., in "Kami Pulp Gijutsu Times", pp. 2 to 4 (September 1985).

Particularly, it is desired to prepare the protective layer using mainly a combination of a polyvinyl alcohol modified with silicon and a colloidal silica in order to obtain the protective layer excellent in transparency and to improve transparency of a heat sensitive recording material remarkably.

Also, waxes and metallic soaps can be used for the prevention of sticking phenomenon. A coverage of such additives is appropriately 0.2 to 7 g/m$^2$.

In preparing the heat sensitive material of the present invention, a proper binder can be used for coating.

Suitable example of binder which can be used include polyvinyl alcohol, methyl cellulose, carboxymethyl cellulose, hydroxypropyl cellulose, gum arabic, gelatin, polyvinyl pyrrolidone, casein, styrene-butadiene latex, acrylonitrile-butadiene latex, various kinds of emulsions such as one of polyvinylacetate, polyacrylic acid esters, ethylene-vinylacetate copolymer and so on. Such a binder is used at a coverage of 0.5 to 5 g/m$^2$ on a solids basis.

The heat sensitive recording material of the present invention is produced by providing a heat sensitive layer on a support, such as paper, a synthetic resin film, etc., coating and drying a coating composition, in which microcapsules enclosing a color former therein and a dispersion containing at least a color developer in an emulsified condition are contained as main components, and further a binder and other additives are incorporated, according to a conventional coating method, such as a bar coating method, a blade coating method, an air knife coating method, a gravure coating method, a roll coating method, a spray coating method, a dip coating method, or so on. A coverage of the heat sensitive layer is controlled to 2.5 to 25 g/m$^2$ on a solid basis.

As for the paper to be used as a support, neutralized paper which is sized with a neutral sizing agent like an alkylketene dimer and shows pH 6–9 upon hot extraction (Japanese Patent Application (OPI) No. 14281/'80) is employed to advantage in the respect of long-range preservation.

In order to prevent the penetration of a coating composition into paper, and in order to effect a close contact between a thermal recording head and a heat sensitive recording layer, paper described in Japanese Patent Application (OPI) No. 116687/82, which is characterized by Stökigt sizing degree/(meter basis weight)$^2 \geqq 3 \times 10^{-3}$ and Beck smoothness of 90 seconds or more, is used to advantage.

In addition, paper having optical surface roughness of 8 microns or less and a thickness of 40 to 75 microns, as described in Japanese Patent Application (OPI) No. 136492/83; paper having a density of 0.9 g/cm$^3$ or less and optical contact rate of 15% or more, as described in Japanese Patent Application (OPI) No. 69097/83; paper which is prepared from pulp having received a beating treatment till its freeness has come to 400 cc or more on a basis of Canadian Standard Freeness (JIS P8121) to prevent permeation of a coating composition thereinto, as described in Japanese Patent Application (OPI) No. 69097/83; raw paper made with a Yankee paper machine, which is to be coated with a coating composition on the glossy side and thereby, improvements on developed color density and resolution are intended, as described in Japanese Patent Application (OPI) No. 65695/83; raw paper which has received a corona discharge processing and thereby, its coating aptitude has been enchanced, as described in Japanese Patent Application (OPI) No. 35985/84; and so on can be employed in the present invention, and can bring about good results. In addition to the above-described papers, all supports which have so far been used for general heat sensitive recording papers can be employed as the support of the present invention.

In the present invention, it is desired to use a transparent support. By using the transparent support, not only a recorded material can be utilized as OHP sheet etc., but also multi coloration can be realized easily by providing heat sensitive layers which color in different hue each other on both side of the transparent support.

Now, a transparent support to be used in the present invention is illustrated below.

The term transparent support as used herein is intended to include films of polyesters such as polyethylene terephthalate, polybutylene terephthalate and the like, cellulose derivative films like a cellulose triacetate film, polyolefin films such as a polystyrene film, a polypropylene film, a polyethylene film and the like and so on. These films may be used, independently or in a laminated form.

A preferred thickness of such a transparent support is within the range of 20 to 200 microns, particularly 50 to 100 microns.

A subbing layer, which can be employed in the present invention, functions so as to heighten the adhesiveness between the transparent support and the heat sensitive layer. As a material for forming the subbing layer, mention may be made of gelatin, synthetic high polymer latexes, nitrocellulose, and so on. A preferred coverage of the subbing layer ranges from 0.1 to 2.0 g/m$^2$, particularly from 0.2 to 1.0 g/m$^2$. When the coverage is below 0.1 g/m$^2$, adhesion of the heat sensitive layer to the support is insufficient, whereas even when it is increased beyond 2.0 g/m$^2$, the adhesion power attains saturation to bring about only increase in cost.

It is to be desired that the subbing layer should be hardened with a hardener because it sometimes swells in water contained in a coating solution to prepare the heat sensitive layer thereon to cause deterioration of image formed in the heat sensitive layer.

As examples of hardeners which can be used in the present invention, mention may be made of:

(1) active vinyl-containing compounds, such as divinylsulfone, N,N'-ethylenebis(vinylsulfonylacetamide), 1,3-bis(vinylsulfonyl)-2-propanol, methylenebismaleimide, 5-acetyl-1,3-diacryloyl-hexahydro-s-triazine, 1,3,5-triacryloyl-hexahydro-s-triazine, 1,3,5-trivinylsulfonylhexahydro-s-triazine, and the like, (2) active halogen-containing compounds, such as sodium salt of 2,4-dichloro-6-hydroxy-s-triazine, 2,4-dichloro-6-methoxy-s-triazine, sodium salt of 2,4-dichloro-6-(4-sulfoanilino)-s-triazine, 2,4-dichloro-6-(2-sulfoethylamino)-s-triazine, N,N'-bis(2-chloroethylcarbamyl)piperazine, and the like, (3) epoxy compounds, such as bis(2,3-epoxypropyl)methylpropylammonium-p-toluenesulfonate, 1,4-bis(2',3'-epoxypropyloxy)-butane, 1,3,5-triglycidylisocyanurate, 1,3-diglycidyl-5-(γ-acetoxy-β-oxypropyl)isocyanurate, and the like.

(4) ethyleneimino compounds, such as 2,4,6-triethylene-s-triazine, 1,6-hexamethylene-N,N'-bisethyleneurea, bis-β-ethyleneiminoethylthioether, and the like, (5) methanesulfonate compounds, such as 1,2-di(methanesulfonoxy)ethane, 1,4-di(methanesulfonoxy)butane, 1,5-di(methanesulfonoxy)pentane, and the like, (6) carbodiimide compounds, such as dicyclohexylcarbodiimide, 1-cyclohexyl-3-(3-trimethylaminopropyl)-carbodiimido-p-triethanesulfonate, 1-ethyl-3-(3-dimethylaminopropyl)carbodiimide hydrochloride, and the like, (7) isooxazole compounds, such as 2,5-dimethylisooxazole perchlorate, 2-ethyl-5-phenylisooxazole-3-sulfonate, 5,5'-(p-phenylene)bisisooxazole, and the like, (8) inorganic compounds, such as chrome alum, bolic acid, zirconium salt, chromium acetate, and the like, (9) dehydrating condensation type peptide reagents such as N-carboethoxy-2-isopropoxy-1,2-dihydroquinoline, N-(1-morpholinocarboxy)-4-methylpyridinium chloride and the like, and active ester compounds such as N,N'-adipolyldioxydisuccinimide, N,N'-terephthaloyl-dioxydisuccinimide and the like,

(10) isocyanates, such as toluene-2,4-diisocyanate, 1,6-hexamethylenediisocyanate and the like,

(11) aldehydes such as glutaric aldehyde, glyoxal, dimethoxy urea, 2,3-dihydroxy-1,4-dioxane and the like.

Among these hardeners, especially aldehydes such as the glutaric aldehyde, the 2,3-dihydroxy-1,4-dioxane etc. and the boric acid are preferable.

Such a hardner is added in a proportion ranging from 0.20 to 3.0 wt % to the weight of the materials to constitute the subbing layer. A proper amount to be added can be selected depending on the coating method, the intended degree of hardening.

When the addition amount of a hardener is below 0.20 wt %, sufficient hardening can not be achieved however long the time elapsed is, and therefore the subbing layer swells upon coating of the heat sensitive layer, whereas when the hardener is added in a concentration higher than 3.0 wt % the hardening proceeds too fast, and therefore the adhesiveness between the subbing layer and the support is lowered to result in peeling off the subbing layer from the support in the form of a film.

According to the hardener used, the pH of a coating solution for the subbing layer can be rendered alkaline by the addition of sodium hydroxide or the like, or acidic by the addition of citric acid or the like, if needed.

Further, a defoaming agent can be added in order to eliminate foams generated upon coating, and a surface active agent can also be added in order to level the surface of the coating solution in a good condition to result in prevention of coating streaks.

Furthermore, an antistatic agent can be added, if needed.

Before coating of the subbing layer, the surface of a support is preferably subjected to an activation processing according to known methods. As a method for the activation processing, mention may be made of an etching processing with an acid, a flame processing with a gas burner, a corona discharge processing, glow discharge processing, and so on. From the viewpoint of cost or simplicity, corona discharge processing described in U.S. Pat. Nos. 2,715,075, 2,846,727, 3,549,406 and 3,590,107, and so on are employed to the greatest advantage.

In the present invention, the heat-sensitive recording material acquires antistatic properties by conductive grains constituting metal oxide(s) incorporated in at least one of its constituent layers or the support thereof to effect the smooth carrying inside the recording apparatus. Instead of or in addition to such layers, a backing layer having antistatic property may be provided on the back side of the support.

Conductive fine grains of metal oxide(s) to be used in the present invention are at least one species selected from a group consisting of ZnO, $TiO_2$, $SnO_2$, $Al_2O_3$, $In_2O_3$, $SiO_2$, MgO, BaO, $MoO_3$ and compound oxides constituted by two or more of these oxides, which has a volume resistivity ranging form $10^0$ to $10^5$ ohm·cm. Of these metal oxides, $SnO_2$ is particularly preferred over others.

The conductive fine grains of metal oxide(s) which can be used in the present invention are prepared with ease mainly using the following method. A first method involves preparing fine grains of metal oxide by burning, then subjecting the metal oxide to a heat treatment in the presence of foreign atoms capable of increasing conductivity. A second method involves carrying out the burning processing for preparing fine grains of metal oxide in the presence of foreign atoms capable of increasing conductivity. A third method involves introducing oxygen defects by lowering an oxygen concentration in the surrounding gas during the burning for preparation of fine grains of metal oxide.

In the first method, the conductivity of the grains can be increased effectively at their individual surfaces, but there is a possibility of grain growth during the heat treatment. Therefore, a condition under which the heat treatment is performed should be selected carefully. In some cases, it is preferred to undergo the heat treatment under a reductive atmosphere. The second method is preferred, because the production seems to cost least. For instance, in a process of producing fine grains of $SnO_2$ by spraying $\beta$-stannic acid colloid (amorphous), or hydrate of $SnO_2$, into a klin, the conductivity can be imparted to fine grains of $SnO_2$ by allowing a hydrate of antimony chloride, antimony nitrate, antimony oxide or the like to be present in the $\beta$-stannic acid colloid. In another process of producing $SnO_2$ or $TiO_2$ by oxidative decomposition of $SnCl_4$ or $TiCl_4$, that is, a so-called vapor phase process, conductive $SnO_2$ or $TiO_2$ can be obtained by making salts of foreign atoms be present at the time of oxidative decomposition. In still another process of producing metal oxides by pyrolysis of organic salts of metals, salts of foreign atoms are made to be present during the pyrolysis. As for the third method, there can be instanced a vacuum evaporation process carried out by evaporating metals in an atmosphere of oxygen to produce fine grains of metal oxides, wherein the metals or salts thereof are heated under an oxygen-deficient atmosphere, or without supplying sufficient oxygen to the evaporation system.

It is desirable that a size of the conductive grains to be used in the present invention should be as small as possible. However, it often occurs that fine grains obtained in accordance with the above-described methods condense strongly to form coarse grains. In order to avoid this condensation phenomenon, it is effective in many cases that fine grains having no direct contribution for improvement on conductivity are made to be present as a finely graining aid in forming conductive grains. Specific examples of grains usable for this purpose include fine grains of metal oxides which have not been prepared with the intention of increasing the conductivity (e.g., ZnO, $TiO_2$, $SiO_2$, $Al_2O_3$, MgO, BaO, $WO_3$, $MoO_3$, etc.), fine grains of sulfates such as $BaSO_4$, $SrSO_4$, $CaSO_4$, $MgSO_4$, etc., fine grains of carbonates such as $MgCO_3$, $CaCO_3$, etc., and so on.

It is feasible to use the grains cited above in such a condition that they are dispersed in a binder together with conductive fine grains. Also, physical or chemical treatments can be performed for the purpose of removing most of fine grains for auxiliary use and most of coarse grains. Specifically, the grains obtained are thrown in liquid, and ground with a ball mill, a sand mill or the like, followed by selective collection of ultrafine conductive grains through filtration, centrifugation or the like. After the above-described grinding procedure, on the other hand, it is more effective to remove auxiliary grains alone by dissolution. It is a matter of course that ultrafine conductive grains can be obtained more efficiently by repeating or combining the above-described procedures. Moreover, previous addition of a surface active agent, a small amount of binder or a small amount of Lewis acid or base as a dispersing aid to a dispersion medium of the grains is much more effective in forming ultrafine conductive grains.

It is obvious that grains usable as auxiliary ones cover a wider range of kinds when chemical procedures are employed together.

Now, an instance of the manner of preparing fine grains is cited below.

In 1,000 pts.wt. of ethanol were dissolved 65 pts.wt. of hydrated stannic chloride and 1.5 pts.wt. of antimony trichloride to make a homogeneous solution. To this solution, a 1N aqueous solution of sodium hydroxide was added dropwise till the pH of the resulting solution reached to 3. Thus, coprecipitate of colloidal stannic oxide and antimony oxide was obtained. This coprecipitate was allowed to stand for 24 hours at 50° C. As the result, it was converted into reddish brown colloidal precipitate. This precipitate and the mother liquor were separated by centrifugation.

Further, addition of water to the precipitate and centrifugation were repeated to achieve the removal of excess ions.

100 pts.wt. of the thus obtained colloidal precipitate was mixed with 50 pts.wt. of barium sulfate having an average grain size of 0.3 micron and 1,000 pts.wt. of water, and sprayed into a klin heated to 900° C. to yield powdery mixture of bluish stannic oxide having an average grain size of 0.1 micron and barium sulfate. A mixture of 10 pts.wt. of the thus obtained $SnO_2$ powder, 50 pts.wt. of a 10% aqueous solution of polyvinyl alcohol (PVA 105, produced by Kurare Co., Ltd.) and 100 pts.wt. of water was subjected to a dispersion processing over a period of 1 hour using a paint shaker (produced by Toyo Seiki Seisakusho K. K.) to obtain a dispersion of fine grains.

In another manner, a mixture of 100 pts.wt. of zinc oxide, 5 pts.wt. of a 10% aqueous solution of $Al(NO_3)_3.9H_2O$ and 100 pts.wt. of water was irradiated with ultrasonic waves for 10 minutes to prepare a homogeneous dispersion. After drying at 110° C. for 1 hour, the resulting dispersion was burnt for 5 minutes at 600° C. under, $1\times10^{-4}$ Torr to yield zinc oxide grains having a specific resistance of $2\times10^{2}$ ohm cm and a grain size of about 2 microns. These grains were ground with a ball mill to be made into fine grains having an average size of 0.7 microns.

A mixture of 10 pts.wt. of thus obtained ZnO powder and 150 pts.wt. of water was subjected to a dispersion processing over a period of 1 hour using a paint shaker to prepare a homogeneous dispersion. From this dispersion, coarse grains were removed by centrifugation carried out at 1,000 r.p.m. for 30 minutes. The remaining supernatant was further centrifuged at 2,000 r.p.m. for 1 hour to obtained ZnO paste consisting of fine grains. 10 pts.wt. of thus obtained ZnO paste was mixed with 25 pts.wt. of a 10% aqueous solution of polyvinyl alcohol and 100 pts.wt. of water, and dispersed thereinto over a period of 1 hour using a paint shaker to prepare a dispersion of ZnO fine grains.

In the present invention, at least one kind of grains among those obtained in the manners as described above is used. In general, these conductive compounds are used at a coverage of about 0.001 g to about 1 g, preferably about 0.05 g to 0.5 g, per square meter of the support.

Although the action of these conductive compounds in preventing static electrification is not necessarily clarified, an antistatic property is imparted to a heat sensitive recording material by adding the compounds to at least one constituent layer of the recording material.

However, the addition to a heat sensitive layer is accompanied by undesirable effects, such as lowering of the heat sensitivity and so on. Therefore, it is particularly desirable that at least one layer, such as a protective layer on the heat sensitive layer, a subbing layer beneath the heat sensitive layer or a backing layer on the back side of a support, should be provided together with the heat sensitive layer, and the foregoing conductive compound(s) should be incorporated into at least one among these layers.

In a preferred embodiment of the present invention, therefore, the heat sensitive recording material is constructed by a support, a heat sensitive layer and at least one layer selected from among a backing layer, a subbing layer and a protective layer, and conductive fine grains are incorporated into at least one constituent layer other than the heat sensitive layer.

EXAMPLES

The present invention is illustrated in greater detail by reference to the following examples. However, the present invention should not be construed as being limited to these examples.

EXAMPLE 1

Preparation of Capsule Solution 14 g of Crystal Violet lactone (leuco dye), 60 g of Takenate D 110N (Trade name of capsule wall material, produced by Takeda Yakuhin K. K.) and 2 g of Sumisoap 200 (an ultraviolet absorbent, produced by Sumitomo Kagaku K. K.) were added to a mixed solvent composed of 55 g of 1-phenyl-1-xylylethane and 55 g of methylene chloride, and dissolved therein. The solution of this leuco dye was mixed with a water solution containing 100 g of a 8% aqueous solution of polyvinyl alcohol, 40 g of water and 1.4 g of a 2% aqueous solution of sodium salt of dioctylsulfosuccinate (dispersant), and emulsified using an Ace Homogenizer (made by Nippon Seiki K. K.) at 10,000 r.p.m. for 5 minutes. Thereto, 150 g of water was further added, and the reaction was run at 40° C. for 3 hours to prepare a capsule solution having a capsule size of 0.7 micron.

Preparation of Emulsified Dispersion of Color Developer

The color developers (a), (b) and (c) having the following structural formulae were dissolved in amounts of 8 g, 4 g and 30 g, respectively, into a mixed solvent composed of 8.0 g of 1-phenyl-1-xylylethane, and 30 g of ethyl acetate. The resulting color-developer solution was mixed with a water solution containing 100 g of a 8% aqueous solution of polyvinyl alcohol, 150 g of water and 0.5 g of sodium dodecylbenzensulfonate, and emulsified at ordinary temperature using an Ace Homogenizer (produced by Nippon Seiki K. K.) at 10,000 r.p.m. for 5 minutes to prepare an emulsified dispersion having a droplet size of 0.5 micron.

Color Developer (a)

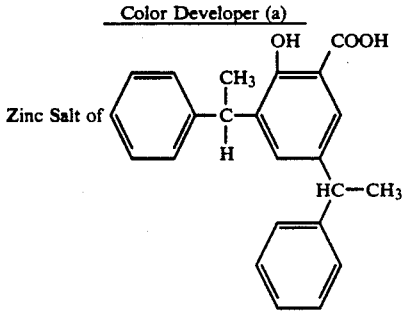

Color Developer (b)

-continued

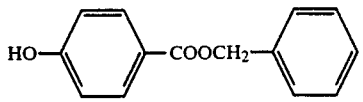

Color Developer (c)

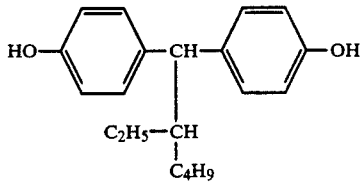

Preparation of Heat Sensitive Material

A 5.0 g portion of the foregoing capsule solution, a 10.0 g portion of the foregoing emulsified dispersion of color developers and 5.0 g of water were mixed with stirring, and coated on one side of a 75 micron-thick transparent polyethylene terephthalate (PET) support at a coverage of 10 g/m$^2$ on a solids basis, and dried to form a heat sensitive layer. Then, a layer having the following composition was coated on the other side of the support as a backing layer at a coverage of 1 g/m$^2$ on a solids basis.

Composition of Backing Layer

Styrene-maleic acid copolymer (Polymalon 385 produced by Arakawa Kagaku K. K.): 1 part (on solid basis), Fine grain dispersion consisting of 10 pts.wt. of $SnO_2$ powder exemplified in this specification, 50 pts.wt. of a 10 wt % of aqueous solution of polyvinyl alcohol (PVA 105, produced by Kurare Co., Ltd.) and 100 pts.wt. of water: 0.05 part.

While thermal printing was performed on the thus obtained heat sensitive recording material using a commercially available printer under the dusty atmosphere of 10° C., 40% RH, unprinted spots were not observed, and any problem was not found.

EXAMPLE 2

Another heat sensitive material was prepared in the same manner as in Example 1, except a subbing layer having the following composition was coated beneath the heat sensitive layer at a coverage of 1 g/m$^2$ instead of providing the backing layer.

Composition of Subbing Layer

Polyvinyl alcohol (PVA 117, produced by Kurare Co., Ltd.): 1 part

Glutaraldehyde: 0.002 part

Dispersion of ZnO fine grains prepared by mixing 10 pts.wt. of ZnO paste exemplified in this specification, 25 pts.wt. of a 10 wt % of aqueous solution of polyvinyl alcohol and 100 pts.wt. of water: 0.05 part.

As the result of the same evaluation test as in Example 1, it was confirmed that no problem was found in thus obtained heat sensitive recording material also.

COMPARATIVE EXAMPLE

Still another heat sensitive recording material was prepared in the same manner as in Example 1, except the fine grain dispersion added to the backing layer in Example 1 was not used at all.

While thus obtained heat sensitive recording material underwent the same evaluation test as in Example 1, adhesion of dust to the surface of the recording material occurred, and thereby some spots where a thermal head was not able to come to direct contact with the recording material surface were generated during thermal printing to result in generation of unprinted spots.

What is claimed is:

1. A heat sensitive recording material comprising a support having thereon constituent layers including: (1) a transparent heat sensitive layer formed by coating a composition containing both: (a) microcapsules containing a colorless or light colored electron donating dye precursor, and (b) an emulsified dispersion prepared by dispersing a color developer dissolved in an organic solvent slightly soluble or insoluble in water then drying the coated composition, and (2) at least one layer selected from among a protective layer provided on the heat sensitive layer, a subbing layer provided beneath the heat sensitive layer and a backing layer provided on the back side of the support; wherein said backing layer contains fine grains of at least one crystalline metal oxide selected from the group consisting of ZnO, $TiO_2$, $SnO_2$, $Al_2O_3$, $In_2O_3$, $SiO_2$, MgO, and $MoO_3$, each of which has a volume resistivity ranging from $10^0$ to $10^5$ ohm·cm.

2. The heat sensitive recording material as claimed in claim 1, wherein said crystalline metal oxide is $SnO_2$.

3. The heat sensitive recording material as claimed in claim 1, wherein fine grains having no direct contribution to improving conductivity are further added to said layer containing crystalline metal oxide.

4. The heat sensitive recording material as claimed in claim 1, wherein the amount of said crystalline metal oxide is 0.0001 g–1 g per $m^2$.

* * * * *